United States Patent [19]

Montgomery

[11] 4,377,236

[45] Mar. 22, 1983

[54] CHILD-RESISTANT PACKAGE WITH TILTING CLOSURE

[75] Inventor: Gary V. Montgomery, Evansville, Ind.

[73] Assignee: Sunbeam Plastics Corporation, Evansville, Ind.

[21] Appl. No.: 242,447

[22] Filed: Mar. 11, 1981

[51] Int. Cl.[3] ..... B65D 55/02; B65D 43/04; B65D 85/56

[52] U.S. Cl. ..... 206/540; 215/296; 220/282; 220/301; 206/534

[58] Field of Search ..... 206/540, 534; 220/282, 220/301; 215/296

[56] References Cited

U.S. PATENT DOCUMENTS

| | | | |
|---|---|---|---|
| 836,091 | 11/1906 | Christensen | 215/296 |
| 1,723,799 | 8/1929 | McDougall | 215/296 |
| 2,493,277 | 1/1950 | Vandier | 220/282 |
| 3,432,058 | 3/1969 | Burgess | 220/301 |

*Primary Examiner*—William T. Dixson, Jr.

*Attorney, Agent, or Firm*—Fisher, Gerhardt, Crampton & Groh

[57] ABSTRACT

A child-resistant package in which a plug type closure has an annular seal acting radially outwardly against the internal wall of the circular opening to provide a seal. A pair of spaced fulcrums are provided by which the closure is tilted relative to the container to disengage the seal and move the closure into a position from which it can be removed from the opening in the container.

12 Claims, 12 Drawing Figures

CHILD-RESISTANT PACKAGE WITH TILTING CLOSURE

This invention relates to child-resistant packages and particularly to packages having a plug type of closure, that is, one not requiring complementary threads to hold the closure in position.

It is an object of the present invention to provide a child-resistant package in which force must be applied in a specific direction at a predetermined location to bring about tilting of a closure relative to a container which permits removal of the closure.

Still another object of some embodiments of the invention is to provide child-resistant packages in which opening of the packages requires a specific orientation of the closure relative to the container in addition to the application of a force in a particular direction and at a predetermined location to bring about the necessary tilting movement of the closure relative to the container.

The child-resistant package of the invention includes a container having a cylindrical or circular opening and a closure which is disposed in the opening. The closure is provided with a seal which acts radially against the inner walls of the opening to seal the package. Opening of the package by removing the closure from the container is accomplished by pressing and tilting the closure about pairs of spaced fulcrums which form a pivot axis to one side of the axis of the cylindrical package. The spaced fulcrums in one embodiment of the invention are formed by the container and in another embodiment of the invention by the closure. In still another embodiment of the invention, the closure and the container both are formed with fulcrums which must be aligned with each other to bring about a condition in which the closure can be tilted relative to the container.

Presently preferred embodiments of the invention are illustrated in the accompanying drawings in which.

Figure 1:
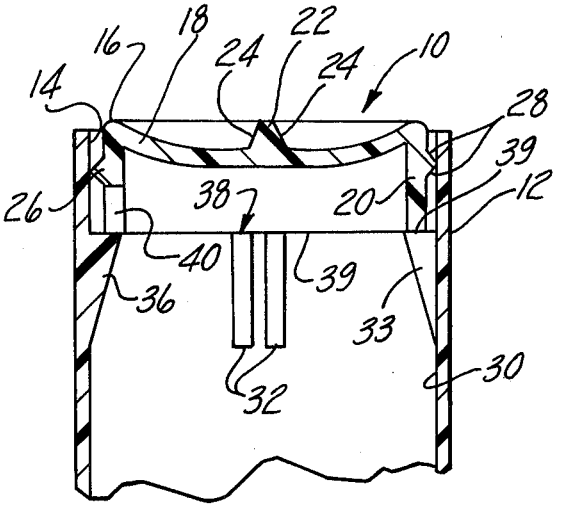
FIG. 1 is a cross-sectional view of the upper portion of a child-resistant package embodying the invention.

Referring to FIGS. 1 through 4, a child-resistant package embodying the invention is designated generally at 10 and includes a container 12 having a circular opening 14 and a plug or closure 16 for sealing and closing the circular opening 14.

The closure 16 has a generally disc-shaped cover portion 18 with a cylindrical skirt 20. The disc 18 can be generally concave and has a diametrically extending rib portion 22. The rib portion 22 has opposed tapered walls 24 which obstruct gripping of the closure 16 to bring about removal. However, the rib 22 permits the closure 16 to be rotated about its axis to selected positions relative to the container 12.

The closure 16 also is provided with an annular seal 26 which has opposed tapered surfaces 28 extending radially outwardly in converging relationship relative to each other. The seal 26 engages the interior cylindrical wall 30 to completely close and seal the container 12.

Figure 2:
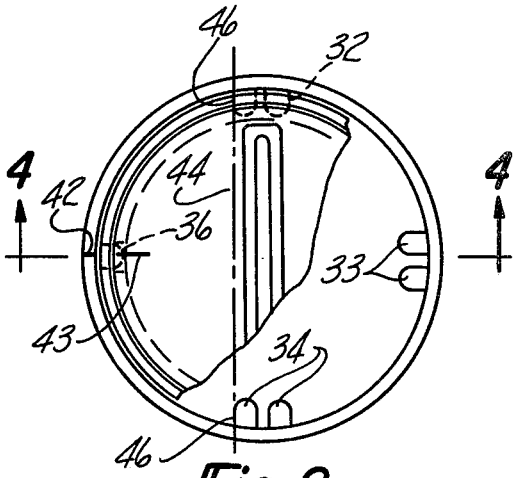
FIG. 2 is a top view of the child-resistant package seen in FIG. 1 with parts broken away and removed.
Figure 3:
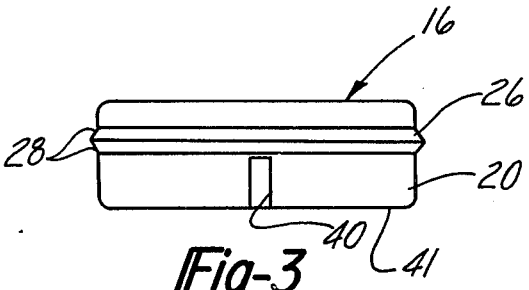
FIG. 3 is a side view of a closure for a container forming the child-resistant package.

The container 12 is provided with three sets or pairs of ribs 32, 33 and 34 spaced apart approximately 90 degrees from each other and extending axially on the inner wall 30 of the container 12. The wall 30 also is provided with a single rib 36 which is disposed substantially diametrically opposite the pair of ribs 33 as seen in FIG. 2. The upper ends of the ribs 32, 33, 34 and 36 form a ledge 38 on which the bottom edge 39 of the closure 16 rests to limit and determine the closed position of the closure 16 relative to the container 12.

The closure 16 is provided with a notch 40 which is slightly wider than the rib 36 and which must be aligned with the rib 36 in order to open the package 10. For this purpose, indicia are provided at 42 and 43 on the container 12 and closure 16, respectively. In the usual closed position of the package 10, the indicia 42 and 43 and therefore the rib 36 and notch 40 will be out of alignment with each other.

Figure 4:
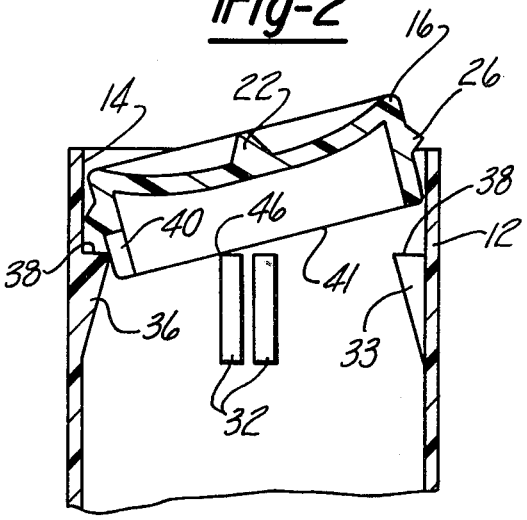
FIG. 4 is a cross-sectional view similar to FIG. 1 but showing a condition of the package during the opening procedure.

When it is desired to open the package 10, the diametrically extending rib 22 is used as a handle to rotate the closure 16 relative to the container 12 to bring the indicia 42 and 43 into radial alignment with each other and to thereby position a portion of the closure with the notch 40 directly above the rib 36. In that condition, it is possible to press on the closure 16 downwardly and axially of the container 12 in the area of the indicia 43 which is radially outward of the axis of the cylindrical opening 14. When this is done, the closure 16 can pivot about an axis indicated at 44 in FIG. 2 and passing through spaced fulcrum points indicated at 46 on the top edge of the ribs 32 and 34 disposed farthest to the left as viewed in FIG. 2. Such pivoting causes the rib 36 to be received in the notch 40 and permits the circumferential edge of closure 16 to tilt into the circumferential space between the fulcrums 46 as illustrated in FIG. 4 about the fulcrum points 46. This moves seal 26 out of engagement with the opening 14 and permits lifting of the closure 16 to open the container 12.

To close the package 10, the closure 16 is aligned with the container 12 and is pushed axially downwardly during which time the annular seal 26 and particularly the tapered underside engages the top edge of the container 12 to guide the closure 16 within opening 14. When the bottom edge 39 of the skirt 20 engages the upper ends of the ribs 32, 33, 34 and 36 the package 10 is closed. Such closing movement can occur with the closure 12 in any rotational orientation relative to the container 12 but opening movement requires alignment of the indicia 42 and 43 so that the notch 40 aligns with the single rib 36 to permit tilting of the closure 16 relative to the container 12.

Another embodiment of the invention is disclosed in FIGS. 5 through 8 in which a package 50 includes a container 52 having a circular opening 54 and a closure 56 sealing and closing the opening 54.

The closure 56 has a generally disc-shaped cover portion 58 with a concave upper surface and a diametrically extending rib 60 similar to the rib 22 of closure 16. These shapes resist axial lifting of the closure 56 relative to the container 52. The closure is provided with an annular seal 64 similar in configuration and operation to the seal 26 of the prior embodiment.

The interior wall 66 of the container 52 is provided with axially extending ribs 68, 69, 70, 71 and 72 which are spaced apart approximately 60 degrees. Ribs 68 and 72, however, are spaced apart approximately 120 degrees and provide circumferentially spaced fulcrum points 73 defining a hinge axis indicated by the broken line 74 in FIG. 6. The closure 56 has its bottom edge 76 resting on the rib 68 through 72 which form a ledge to limit downward axial movement of the closure 56 relative to the container 52.

Figure 7:
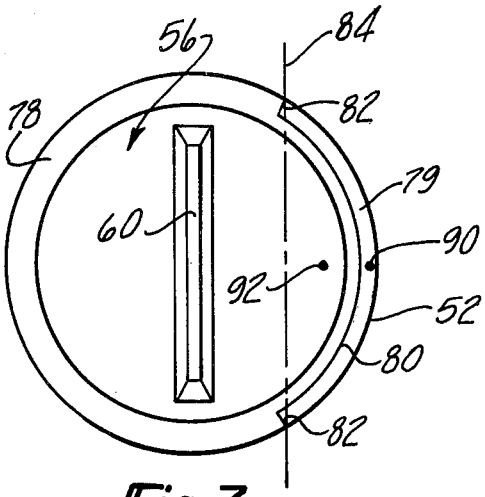
FIG. 7 is a top view of the closed package of FIG. 5.
Figure 8:
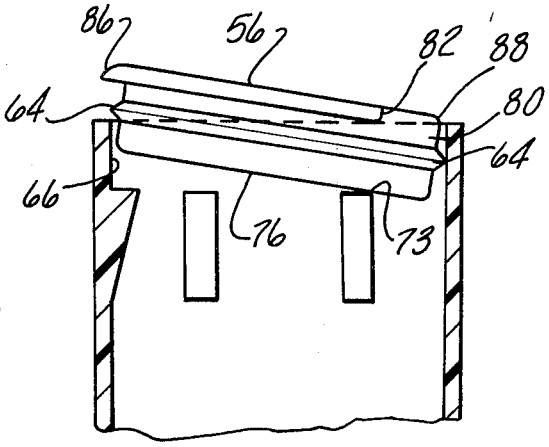
FIG. 8 is a view similar to FIG. 4 showing the condition of the package during the opening procedure.

Referring to FIGS. 7 and 8, the closure 56 also is provided with a radially extending flange 78 which extends around the perimeter of the closure 56 approximately 240 degrees. The remaining 120 degrees of the perimeter forms an arcuate wall 80 which has a radius slightly less and no greater than the inside radius of the interior wall 66 of the container 52. Points 82 at opposite ends of the flange 78 and the arcuate wall 80 define an axis indicated at 84 in FIG. 7. In a closed position of the package 50 illustrated in FIG. 5, the radial flange 78 rests on top of the upper edge 85 of the container 52 whereas in the area of the arcuate wall 80, the upper edge 85 is exposed. In the usual closed position of the package 50, the imaginary pivot axis 74 of the container 52 will be out of line with the imaginary line 84 of the closure 56. In that condition, the closure 56 is supported by the ribs 68 through 72 as well as by the radial flange 78 of the closure 56. In such a closed position, curved portions 86 of the flange 78 and 88 of the arcuate wall 80 form means resists gripping to prevent opening of the package 50 except by the proper opening procedure.

To open a package 50, it is necessary to align the portion on the closure between the fulcrum 82 and the space on the container between the fulcrum 73. This brings the imaginary pivot axes 74 and 84 as well as the fulcrums 82 and 73 into alignment. For this purpose indicia indicated at 90 on the container 54 and at 92 on the clousre 56 are provided as viewed in FIG. 7. Alignment of the indicia 90 and 92 places the package 50 in condition for opening such that the application of downward or axial pressure with a finger to the radially outer side of the imaginary line 84 such as in the area of the dot forming the indicia 92 serves to pivot the closure about either or both of the fulcrums 73 and 82. This causes the seal 64 to move out of engagement with the inner surface of the inner wall 66 of the container 52 and permits removal of the closure 56.

To close the package 50, the closure 56 is pushed axially downwardly with the container 52 and closure 56 substantially coaxially aligned. This causes the annular seal 64 and particularly the tapered under surface to engage the top edge of the container 52 until the bottom edge of the closure 56 engages the top of the ribs 68 through 72 and the bottom of the radial flange 78 engages the top edge of the container 52. Such closing movement can occur with the closure 56 in any angular orientation relative to the container 52, but opening movement requires rotation of the closure 56 by means of the rib 60 until the indicia 92 and 90 in FIG. 7 are aligned.

Figure 9:
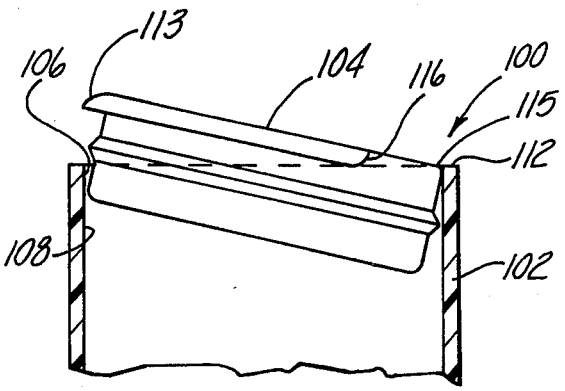
FIG. 9 is a cross-sectional view of a portion of a child-resistant package embodying the invention, but showing still another embodiment.
Figure 10:
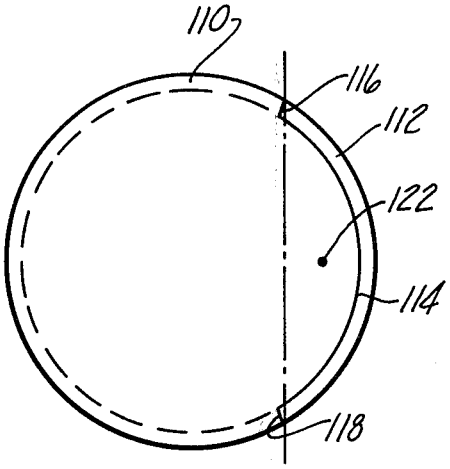
FIG. 10 is a top view of the embodiment in FIG. 9 showing the package in a closed condition.

Referring now to FIGS. 9 and 10, a third embodiment of the invention is shown in which a package 100 includes a container 102 and a closure 104. The container 102 forms a cylindrical opening 106 with an interior wall 108 which is unobstructed with ribs or flanges. The closure 104 is generally similar to the closure 56 except that it is unnecessary to provide a handle or rib such as the rib 60 to rotate the closure 104. Consequently, the top of the closure 104 can be flat with a flange 110 extending around approximately 240 degrees of the circumference of the closure 104. In the closed position of the package 100, the flange 110 rests on the top edge 112 of the container and the flange 110 is curved as indicated at 113 to provide a surface which does not afford a grip for removing the closure 104 from the container 102.

The closure 104 has an arcuate wall 114 between ends 116 and 118 of flange 110. In a closed condition of the package 100, the radius of the wall portion 114 is approximately the same or slightly less than the inner radius of the wall 108 of the container. The wall 114 is provided with a curved edge 115 to resist gripping. Also, the closure 104 has a sealing rib 120 which is generally similar to the seals 26 and 64 of the other two embodiments of the invention. The closure can be provided with indicia such as that indicated at 122 to indicate a pressure point for opening of the package 100.

To close the package 100, the closure 104 is axially aligned with the container 102 and pressure is applied downwardly to force the seal rib 120 into the opening 106 until the underside of the flange 110 engages the top edge 112 of the container 102. No particular angular orientation of the closure and container are required to produce closing of the package 100. Similarly, the package 100 does not require prior orientation in order to displace the closure to the tilted or opening condition as illustrated in FIG. 9. The application of downward pressure at the pressure point 122 in FIG. 10 which is radially outward and to one side of an axis passing through the ends 116 and 118 of the flange 110 causes the ends to act as fulcrums on the top edge 112 of the container 102 so that the closure 104 tilts as seen in FIG. 9 permitting removal of the closure from the container 102.

Although the closure 104 does not require a specific angular orientation relative to the container 102, the fact that the closure requires the application of pressure at a specific location and the exertion of some physical force makes the container substantially child resistant.

Figure 11:
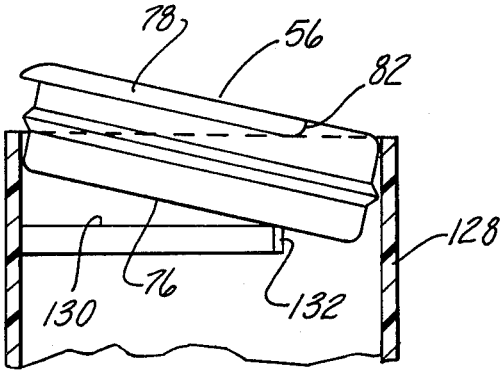
FIG. 11 is a modification of the embodiments illustrated in FIGS. 1 and 5.

Referring now to FIG. 11, a modification is shown which can be made to the container of either of the packages 10 or 50. In this modification, a container 128 is provided with an annular ledge 130 which extends partially around the circumference of the inner wall of the container. The ends of the ledge form fulcrum points 132 about which closures 16 or 56 can pivot. The closure 56 illustrated in FIG. 11 is identical with the closure seen in FIG. 7 in all respects. In the closed position of the container 128, the flange 78 engages the top edge of the container and the bottom edge 76 of the closure engages the top of the ledge to determine the closed position. To open the container, the indicia 90 and 92 must be aligned in the same manner as illustrated in FIG. 7. Thereafter, the closure 56 can be tilted to the positions illustrated in FIG. 11 about either or both of the fulcrums 132 offered by the ledge 130 on the container or the ends of the flange 82 on the closure.

Figure 12:
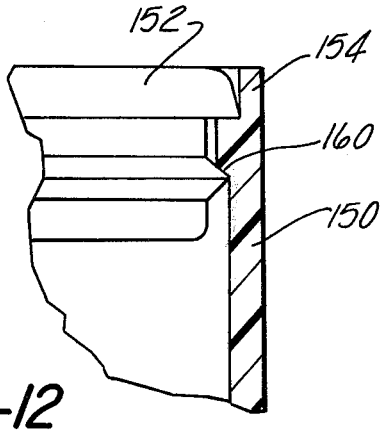
FIG. 12 is a fragmentary sectional view showing further modifications of the embodiments in FIGS. 1, 5 and 9.

Although the closures 56 and 104 illustrated in FIGS. 7 and 9 are provided with curved portions 86, 88, 113 and 114 to make it difficult to grip the closures, additional means to resist gripping can be provided as illustrated in FIG. 12. A container 150 such as the container 52 or 102 used with a closure 152 such as closures 56 or 104 can be provided with an additional annular lip 154 extending around the entire circumference of the opening in the container and extending to a height of the closure 152. This restricts access to even the curved portion 114 and resists gripping for opening of the package.

Figure 5:
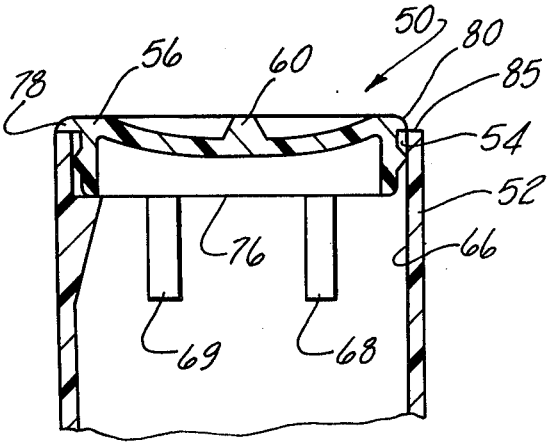
FIG. 5 is a cross-sectional view similar to FIG. 1 of another embodiment of the invention.
Figure 6:
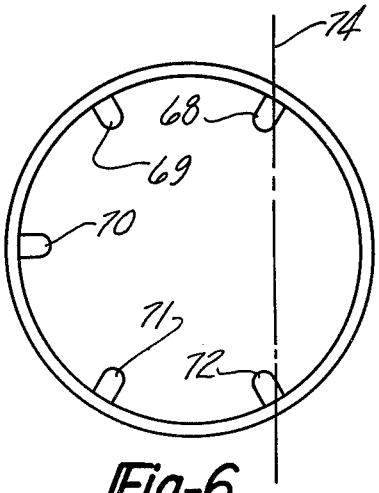
FIG. 6 is a top view of the container portion of the child-resistant package of FIG. 5.

If desired, the sealing and closing characteristics of any of the containers 12, 52, 102 or 150 can be enhanced as illustrated in FIG. 12 by providing a ridge or flange 160 on the inner wall of the container to coact with the upper surface of the annular seal 26 in FIG. 1 and 64 in FIGS. 5, 9 and 11. In that case, the closure will be more firmly held relative to the container and during closure will afford an audible sound when the closure snaps into sealing position. Opening movement is obtained in the same manner, namely by tilting the closure about fulcrums so that the closure can be removed from the container.

A child-resistant package has been provided in which an annular seal on a closure coacts with the container to seal the package and in which spaced fulcrums are formed by either the closure or the container or both for pivotal movement of the closure relative to the container about a pivot axis which is disposed to one side of the axis of the package. The closure is tiltable from a closed position to an open position upon exertion of axial pressure at a predetermined location radially outwardly of the pivot axis to move the seal out of engagement with the wall of the container and permit removal of the closure from the container. In one embodiment of the invention, such tilting movement can be obtained without orientation of the closure relative to the container, but in the remaining embodiments of the invention, a predetermined orientation is required as well as the application of downward pressure in a predetermined location on the closure in order to tilt the closure relative to the container and complete the opening operation of the package.

The embodiments of the invention in which an exclusive property or privilege is claimed are defined as follows:

1. A child-resistant package comprising: a container having a cylindrical inner wall forming a circular opening, a closure having an annular seal disposed in said opening and acting radially outwardly to sealingly engage said cylindrical wall of said container to close said opening, a pair of circumferentially spaced fulcrums formed within said container and below said cylindrical wall and being engageable with said closure, said spaced fulcrums defining the ends of a pivot axis disposed transversely to and at one side of said axis of said opening, means for rotating said closure about the axis of said container, said closure having a portion alignable with the circumferential space between said fulcrums on said container upon rotation of said closure to a predetermined location, said closure having portions shaped to prevent axial lifting and being tiltable in said predetermined location from a closed position to an open position upon exertion of pressure in an axial direction on said closure at a location radially outwardly of said pivot axis to move portions of said seal out of engagement with said wall for removal of said closure from said opening in said container.

2. A child-resistant package according to claim 1 wherein a partial annular ledge is formed on said inner wall and engages and supports the bottom of said closure when the latter is in a closed position relative to said container, said ledge forming said fulcrums and defining a space therebetween to receive said closure upon tilting thereof.

3. A child-resistant package according to claim 1 and further comprising indicia on said container and said closure alignable with each other when said closure and container are in said predetermined relative positions.

4. A child-resistant package of claim 2 wherein said ledge is formed by axially extending ribs.

5. The child-resistant package of claim 2 wherein said ledge is formed by a flange extending continuously between said fulcrums over a major portion of the perimeter of the interior of said closure.

6. The child-resistant package of claim 1 and further comprising a flange of the closure extending partially around a major portion of the perimeter of said closure for engagement with the top of said container, opposite ends of said flange defining therebetween said portion alignable with said circumferential space and forming an arcuate edge having a radius no greater than the inside radius of said container opening.

7. A child-resistant package according to claim 2 and further comprising a lock element formed in said circumferential space, a notch formed in the perimeter of said closure to receive said lock element upon alignment and tilting of said closure relative to said container.

8. The child-resistant package of claim 7 wherein said ledge is formed by annularly spaced pairs of ribs, the ribs of each pair having an annular spacing greater than the annular width of said lock element.

9. The child-resistant package of claim 6 wherein opposite ends of said flange forms a pair of additional fulcrums spaced apart circumferentially the same distance as said first named fulcrums, said closure being tiltable to an opened position upon rotation of said closure relative to said container to bring said first mentioned and additional fulcrums into alignment with each other.

10. The child-resistant package of claim 2 and further comprising means to rotate said closure relative to said container while said closure is in a closed position relative to said container.

11. The child-resistant package of claim 1 and further comprising an annular flange on the interior wall of said container complementary to and disposed above said annular seal of said closure when the latter is in a closed position to releasably resist opening movement of said closure.

12. The child-resistant package of claim 6 wherein said container is provided with an annular lip extending around said closure and to a height substantially equal to the top of said closure to obstruct access to the sides of said closure.

* * * * *